US009925768B2

(12) United States Patent
Kondo

(10) Patent No.: US 9,925,768 B2
(45) Date of Patent: Mar. 27, 2018

(54) LIQUID DISCHARGE HEAD, LIQUID DISCHARGE DEVICE, AND LIQUID DISCHARGE APPARATUS

(71) Applicant: Naoya Kondo, Kanagawa (JP)

(72) Inventor: Naoya Kondo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/350,447

(22) Filed: Nov. 14, 2016

(65) Prior Publication Data

US 2017/0144435 A1 May 25, 2017

(30) Foreign Application Priority Data

Nov. 25, 2015 (JP) ..... 2015-229573

(51) Int. Cl.
*B41J 2/045* (2006.01)

(52) U.S. Cl.
CPC ..... *B41J 2/04588* (2013.01); *B41J 2/0459* (2013.01); *B41J 2/04581* (2013.01); *B41J 2/04586* (2013.01)

(58) Field of Classification Search
CPC .. B41J 2/04588; B41J 2/0459; B41J 2/04586; B41J 2/04581
See application file for complete search history.

(56) References Cited

U.S. PATENT DOCUMENTS

2009/0115821 A1* 5/2009 Tsukamoto ..... B41J 2/04581 347/68
2015/0077475 A1 3/2015 Mizukami et al.
2015/0263263 A1 9/2015 Akiyama et al.
2015/0266296 A1 9/2015 Mizukami et al.
2015/0283811 A1 10/2015 Kondo
2016/0225976 A1* 8/2016 Yokoyama ..... H01L 41/1873
2016/0263892 A1* 9/2016 Mizukami ..... B41J 2/14233
2016/0263893 A1* 9/2016 Mizukami ..... B41J 2/14233

FOREIGN PATENT DOCUMENTS

JP 2009-071113 4/2009
JP 2014-054800 3/2014
JP 2014-060330 4/2014
JP 2014-177061 9/2014

* cited by examiner

*Primary Examiner* — Alessandro Amari
*Assistant Examiner* — Roger W Pisha, II
(74) *Attorney, Agent, or Firm* — Cooper & Dunham LLP

(57) ABSTRACT

A liquid discharge head includes a nozzle plate, a diaphragm, an electromechanical transducer element, and a characteristic fluctuation suppressor. The nozzle plate has a nozzle orifice communicated with a chamber to discharge a discharge liquid stored in the chamber. The diaphragm divides a part of the chamber. The transducer element is disposed on the diaphragm and includes a lamination of a lower electrode, an electromechanical transducer film, and an upper electrode. The suppressor applies a characteristic fluctuation suppression voltage to suppress characteristic fluctuation of the transducer element in a section between a drive waveform applied to the transducer element and a subsequent drive waveform. The suppressor sets the suppression voltage to be larger than a negative coercive electric field of the transducer film and smaller than a positive coercive electric field of the transducer film and have a waveform that does not discharge the liquid in the chamber.

10 Claims, 12 Drawing Sheets

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2015-229573 filed on Nov. 25, 2015 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

An inkjet liquid discharge head (hereinafter, simply referred to as a "liquid discharge head") has been employed for an image forming apparatus, such as a printer, a facsimile, or a copying apparatus. Such a liquid discharge head includes, for example, nozzles to discharge ink droplets, a pressurizing chamber to communicate with the nozzles, an electromechanical transducer element to pressurize ink in the pressurizing chamber, a diaphragm to form a wall surface of an ink channel, and an energy generator formed of an electrode facing the diaphragm. In the liquid discharge head, the electromechanical transducer element is driven by the energy generated with the energy generator to pressurize the pressurizing chamber, thus discharging ink droplets from the nozzles.

As the liquid discharge head, two types of heads are known that employ an electromechanical transducer actuator having a vertical vibration mode to extend or contract in an axial direction of the electromechanical transducer element and a head employing an electromechanical transducer actuator having a flexural vibration mode. Of the above-described two modes, formation of the head employing an electromechanical transducer actuator having a flexural vibration mode is as follows. That is, the head is formed by forming a uniform electromechanical transducer material layer on an entire surface of a diaphragm by a film formation technology, and dividing the electromechanical transducer material layer so as to be independent corresponding to each pressurizing chamber by a lithography method.

In the above-described electromechanical transducer film, extension or contraction occurs effectively in accordance with increase or decrease of an electric field application intensity when a vector component of a spontaneous polarization axis of the electromechanical transducer film is equal to an electric field application direction. Accordingly, a large electromechanical transducer constant is obtained, and the spontaneous polarization axis of the electromechanical transducer film is preferably completely equal to the electric field application direction.

In the above-described liquid discharge head, a displacement of the electromechanical transducer element fluctuates according to repeated drive of the electromechanical transducer element, and a liquid discharge characteristic, such as a liquid discharge amount or a liquid discharge-speed, may not be stable. In particular, in an initial stage just after a drive operation is started, the displacement of the electromechanical transducer element may fluctuate significantly.

Hence, in a technology, an aging step (also referred to as "polarization processing" by paying attention to a polarization state) to drive an electromechanical transducer element by applying a drive signal with a higher voltage and a higher frequency than a real drive voltage to the electromechanical transducer element with a predetermined pulse number is performed. In addition, a technology is known in which fluctuation is suppressed by introducing a voltage waveform different from a real drive voltage waveform.

SUMMARY

In an aspect of the present disclosure, there is provided a liquid discharge head that includes a nozzle plate, a diaphragm, an electromechanical transducer element, and a characteristic fluctuation suppressor. The nozzle plate has a nozzle orifice communicated with a pressure liquid chamber to discharge a discharge liquid stored in the pressure liquid chamber. The diaphragm divides a part of the pressure liquid chamber. The electromechanical transducer element is disposed on the diaphragm. The electromechanical transducer element includes a lamination of a lower electrode, an electromechanical transducer film, and an upper electrode. The characteristic fluctuation suppressor applies a characteristic fluctuation suppression voltage to suppress characteristic fluctuation of the electromechanical transducer element in a section between a drive waveform applied to the electromechanical transducer element and a subsequent drive waveform. The characteristic fluctuation suppressor sets the characteristic fluctuation suppression voltage to he larger than a negative coercive electric field of the electromechanical transducer film and smaller than a positive coercive electric field of the electromechanical transducer film and have a waveform that does not discharge the discharge liquid in the pressure liquid chamber.

In another aspect of the present disclosure, there is provided a liquid discharge device that includes the liquid discharge head.

In still another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 4A illustrates a case where a voltage lower than a coercive electric field is 0 V or less, and FIGS. 4B and 4C each illustrate a case where the voltage lower than a coercive electric field is 0 V or more;

FIG. 9A illustrates a graph at a high temperature, and FIG. 9B illustrates a graph at a low temperature;

Figure 1:
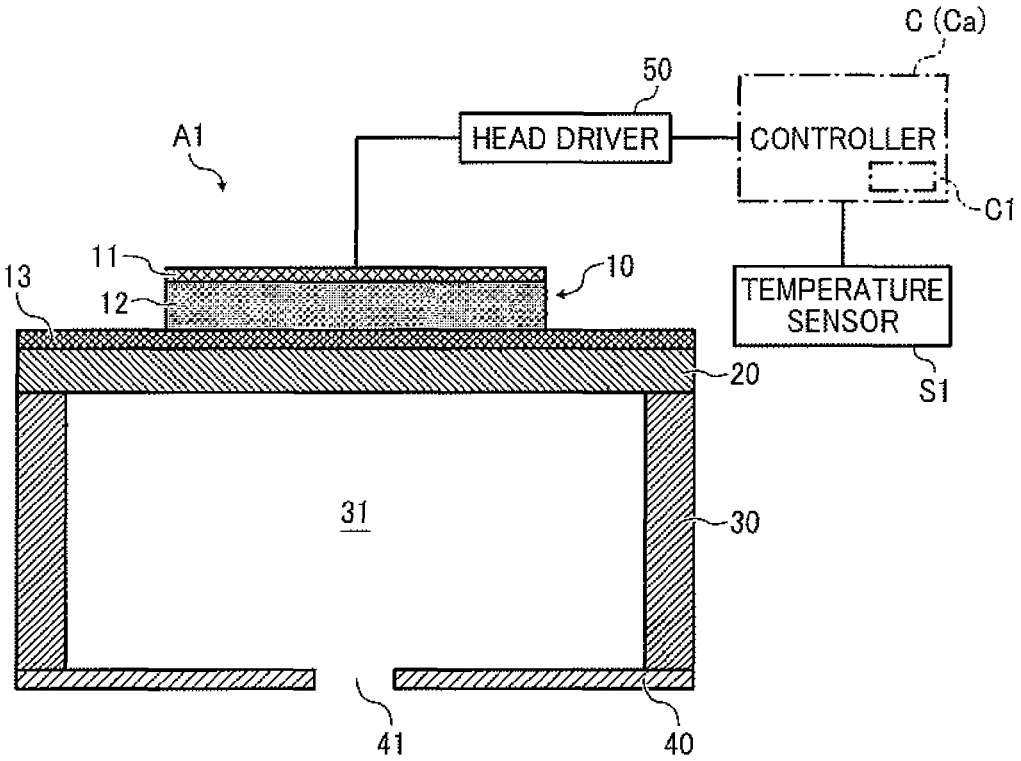
FIG. 1 is an enlarged cross sectional view illustrating a schematic configuration of a liquid discharge head according an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
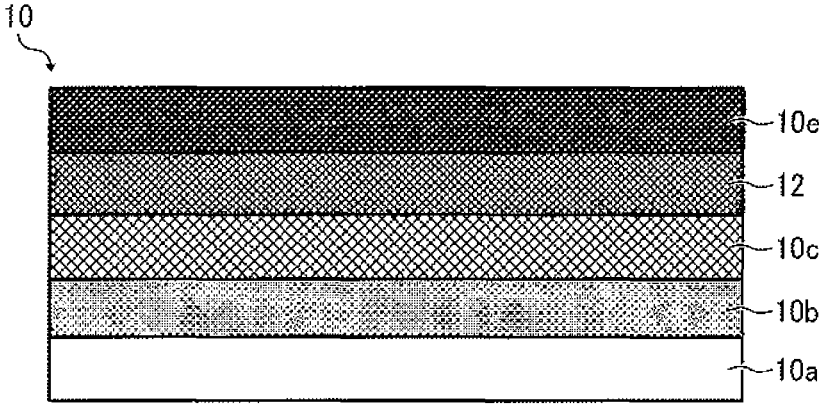
FIG. 2 is an enlarged cross sectional view illustrating a detailed configuration of an electromechanical transducer element used for the liquid discharge head.
Figure 3A:
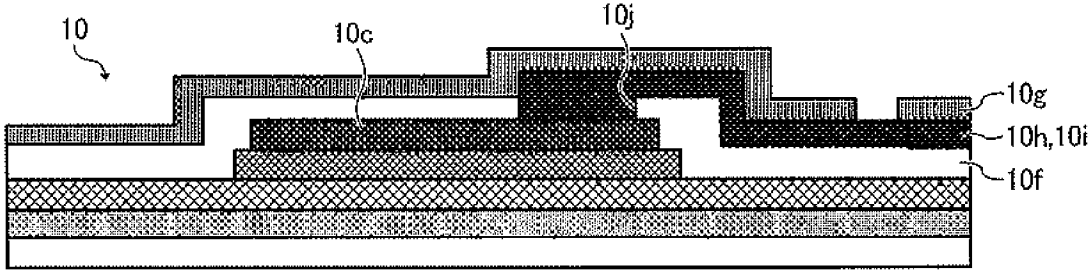
FIG. 3A is a front cross sectional view illustrating a detailed configuration of the electromechanical transducer element.
Figure 3B:
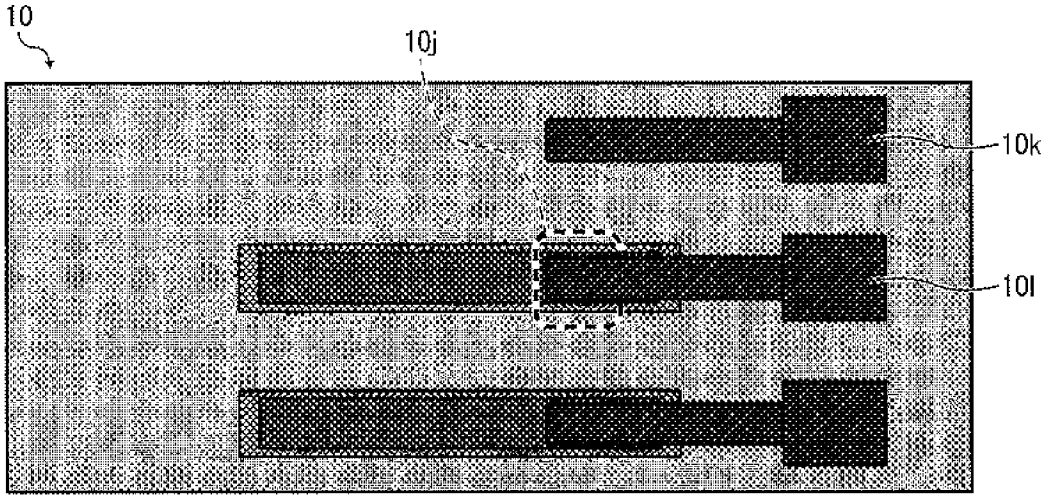
FIG. 3B is a top view of the electromechanical transducer clement.

Hereinafter, the present disclosure will be described in detail with reference to the drawings. FIG. 1 is an enlarged cross sectional view illustrating a schematic configuration of a liquid discharge head according an embodiment of the present disclosure. FIG. 2 is an enlarged cross sectional view illustrating a detailed configuration of an electromechanical transducer element used for the liquid discharge head. FIG. 3A is a front cross sectional view illustrating a detailed configuration of the electromechanical transducer element, and FIG. 3B is a top view of the electromechanical transducer element.

As illustrated in FIG. 1, a liquid discharge head A1 according to an embodiment of the present disclosure mainly includes an electromechanical transducer element 10, a diaphragm 20, a pressure chamber substrate 30, and a nozzle plate 40.

The pressure chamber substrate 30 is formed into a frame shape so as to divide a pressure liquid chamber 31 to store a discharge liquid which is a liquid. The diaphragm 20 is a component to divide a part of the pressure liquid chamber 31 and to cause pressure fluctuation in the pressure liquid chamber 31, and is formed into a flat plate shape. An outer periphery of the diaphragm 20 is bonded to the pressure chamber substrate 30. The nozzle plate 40 has a nozzle orifice 41 to communicate with the pressure liquid chamber 31 and to discharge a discharge liquid in the pressure liquid chamber 31, and has a plate shape. By disposing the diaphragm 20 on an upper surface of the pressure chamber substrate 30 and disposing the nozzle plate 40 on a lower surface of the pressure chamber substrate 30, the pressure liquid chamber 31 is divided and formed in the pressure chamber substrate 30.

The electromechanical transducer element 10 illustrated in FIG. 1 is obtained by stacking an upper electrode 11, an electromechanical transducer film 12, and a lower electrode 13. In the present embodiment, the upper electrode 11 is used as an individual electrode, and the lower electrode 13 is used as a common electrode. The configuration of the electromechanical transducer element 10 is not limited to the configuration illustrated in FIG. 1, but may be a configuration illustrated in FIG. 14 described in detail below, of course.

As illustrated in FIG. 2, the electromechanical transducer element 10 is obtained by stacking a substrate 10*a*, a film formation diaphragm 10*b*, a first electrode 10*c*, the electromechanical transducer film 12, and a second electrode 10*e* on one another. The electromechanical transducer element 10 further includes a first insulating protective film 10*f*, a second insulating protective film 10*g*, a third electrode 10*h*, a fourth electrode 10*i*, and leading-out wiring illustrated in FIG. 3A. The first insulating protective film 10*f* has a contact hole 10*j*. The first electrode 10*c* is conductive to the third electrode 10*h*, and the second electrode 10*e* is conductive to the fourth electrode 10*i*.

In such a case, by using the first electrode 10*c* and the third electrode 10*h* as common electrodes and using the second electrode 10*e* and the fourth electrode 10*i* as individual electrodes, the second insulating protective film 10*g* to protect the common electrodes and the individual electrodes is formed, and a part of the second insulating protective film 10*g* is opened to form an electrode PAD. An electrode formed for a common electrode is referred to as a common electrode PAD 10*k* and an electrode formed for an individual electrode is referred to as an individual electrode PAD 10*l*.

In the electromechanical transducer element 10, the lower electrode 13 is etched so as to have a desired shape to the upper electrode 11 and the electromechanical transducer film 12. Thereafter, the first insulating protective film 10*f* and the second insulating protective film 10*g* are formed, and etching is performed from a side of the substrate 10*a* to form the pressure liquid chamber 31 to discharge a discharge liquid such as an ink illustrated in FIG. 1.

To secure discharging performance at a high frequency, a Young's modulus and a film thickness of each of the diaphragm 20, the electromechanical transducer film 12, the first insulating protective film 10*f*, and the second insulating protective film 10*g* are increased to enhance the rigidity.

Particularly, the diaphragm 20 is formed so as to include a plurality of layers formed of a material of $SiO_2$, SiN, or Poly-Si and so as to have a film thickness of 1 μm or more and 3 μm or less considering a stress design. Furthermore, discharging performance at a high frequency is secured by setting the Young's modulus of the diaphragm 20 to 75 GPa or more and 95 GPa or less.

In the present embodiment, the pressure chamber substrate 30 is formed of a monocrystalline silicon substrate having a thickness of 100 to 600 μm. As plane orientations of the above-described monocrystalline silicon substrate, three types of (100), (110), and (111) are known. Generally, (100) and (111) planes are widely used. In the present embodiment, a monocrystalline silicon substrate having (100) plane orientation is mainly employed.

In fabricating the pressure liquid chamber 31 as illustrated in FIG. 1, a monocrystalline silicon substrate is processed by etching. In such a case, the anisotropic etching is typically used as a method of etching. The anisotropic etching uses the property that an etching speed is different for each plane orientation of a crystal structure. For example, for the anisotropic etching in which the substrate is immersed in an alkaline solution, such as potassium hydroxide (KOH), the etching speed of (111) plane is approximately 1/400 of the etching speed of (100) plane.

Therefore, a structure having an inclination of about 54° can be formed in (100) plane orientation. On the other hand, a deep groove can be formed in (110) plane orientation. Therefore, an arrangement density can be increased while rigidity is further maintained. In the present embodiment, a monocrystalline silicon substrate having (110) plane orientation can he also used. In such a case, the monocrystalline silicon substrate having (110) plane orientation is used by paying attention to a fact that silicon dioxide ($SiO_2$) as a mask material may be also etched.

The width of the pressure liquid chamber 31 is preferably from 50 μm or more and 70 μm or less, and more preferably from 55 μm or more and 65 μm or less. When the width is more than the above-described value, a residual vibration is larger and it is difficult to secure discharging performance at a high frequency. When the width is less than the above-described value, a displacement is decreased, and a sufficient discharge voltage may not be secured.

The diaphragm 20 is deformed and displaced by receiving a force generated by the electromechanical transducer film 12, and discharges a discharge liquid in the pressure liquid chamber 31. Therefore, a component having predetermined strength is preferably used as the diaphragm 20.

As a material of the diaphragm 20, a material produced by subjecting silicon (Si), $SiO_2$, silicon nitride ($Si_3N_4$), or the like to a chemical vapor deposition (CVD) method can be used. A material having a linear expansion coefficient close to that of each of the lower electrode 13 and the electromechanical transducer film 12 illustrated in FIG. I is preferably selected. As a material of the electromechanical transducer film 12, lead zirconate titanate (PZT) is generally used. From the above, a material having a linear expansion coefficient of $5\times10^{-6}$ to $10\times10^{-6}$ close to a linear expansion coefficient $8\times10^{-6}$ (1/K) is preferable. Furthermore, a material having a linear expansion coefficient of $7\times10^{-6}$ to $9\times10^{-6}$ is more preferable.

Examples of the materials of the diaphragm 20 include aluminum oxide, zirconium oxide, iridium oxide, ruthenium oxide, tantalum oxide, hafnium oxide, osmium oxide, rhenium oxide, rhodium oxide, palladium oxide, and compounds of the foregoing materials. Using such materials, the diaphragm 20 is produced by a spin coater using a sputtering method or a sol-gel method. The film thickness is preferably in a range of from 0.1 μm to 10 μm, and more preferably in a range of from 0.5 μm to 3 μm. If the film thickness of the diaphragm 20 is less than the range, the pressure liquid chamber 31 may not be easily processed. If the film thickness of the diaphragm 20 is greater than the range, the diaphragm 20 may be less deformed and displaced, thus hampering stable discharge of droplets.

As the metal material of the lower electrode 13 and the upper electrode 11, for example, platinum (Pt) having high heat resistance and low reactivity is typically used. However, platinum may not have a sufficient barrier property against lead, and platinum group elements, such as iridium and platinum-rhodium, or alloy films of the foregoing materials may be used. When platinum is used, adhesion of platinum with a base (in particular, $SiO_2$) may be poor. Therefore, for example, Ti, $TiO_2$, Ta, $Ta_{205}$, or $Ta_3N_5$ is preferably laminated in advance. As a method of manufacturing the metal electrode film, vacuum film formation such as a sputtering method or a vacuum vapor deposition method is generally used. The film thickness is preferably in a range of from 0.05 μm to 1 μm, and more preferably in a range of from 0.1 μm to 0.5 μm.

In addition, an oxide electrode film formed of $SrRuO_3$ or $LaNiO_3$ as a material may be used between the above-described metal material and the electromechanical transducer film 12. Particularly, a material selected for an oxide electrode film between the lower electrode 13 and the electromechanical transducer film 12 depends on a direction having an orientation priority because the material has an influence on orientation control of an electromechanical transducer film (for example, a PZT film) 12 produced on the oxide electrode film.

In the present embodiment, PZT (100) as an electromechanical transducer film has an orientation priority. Therefore, as the second electrode 103, a seed layer such as $LaNiO_3$, $TiO_2$ seed, or $PbTiO_3$ is produced on the first electrode 10*c*, and then a PZT film is formed. $SrRuO_3$ is used as an oxide electrode film between the upper electrode 11 and the electromechanical transducer film 12, and the film thickness of the oxide electrode film is preferably from 20 nm to 80 nm, and more preferably from 30 nm to 50 nm. When the film thickness is smaller than the above-described film thickness range, a sufficient characteristic of an initial displacement or a displacement deterioration characteristic may not be obtained. On the other hand, when the film thickness is larger than the range, a dielectric strength voltage of PZT which is subjected to film formation later is very poor, and the amount of current leakage is large.

PZT is mainly used as the material of the electromechanical transducer film 12. The PZT is a solid solution of lead zirconate ($PbTiO_3$) and titanium acid ($PbTiO_3$) and has a characteristic different according to a ratio of the lead zirconate ($PbTiO_3$) and the titanium acid ($PbTiO_3$). When the ratio of $PbZrO_3$ and $PbTiO_3$ is 53:47, the PZT film 406 has a generally excellent piezoelectric properly. The composition is represented by a chemical formula of Pb $(ZrO_{0.53}Ti_{0.47})$ $O_3$, generally, PZT(53/47)

An example of composite oxide other than the PZT includes barium titanate. In such a case, barium alkoxide and titanium alkoxide compounds are used as a starting material and are dissolved in a common solvent, to prepare a barium titanate precursor solution. However, when PZT(100) plane has a priority orientation, a composition ratio of Zr/Ti is preferably 0.45 or more and 0.55 or less, and more preferably 0.48 or more and 0.52 or less when being represented by Ti/(Zr+Ti).

In the present embodiment, PZT(100) preferably has a priority orientation. A crystal orientation is represented by $\rho(hkl)=l(hkl)/\Sigma l(hkl)$ [$\rho(hkl)$: orientation degree in (hkl) plane direction, l(hkl): peak intensity in any orientation, $\Sigma l(hkl)$: sum of peak intensities]. When the sum of peak intensities obtained by $\theta-2\theta$ measurement in an X-ray diffraction method is assumed to be 1, an orientation degree in (100) orientation calculated on the basis a ratio of a peak intensity in each orientation is preferably 0.75 or more, and more preferably 0.85 or more. When the orientation degree is less than the value, a sufficient piezoelectric strain may not be obtained, and a displacement may not be secured sufficiently.

The materials are represented by a general formula $ABO_3$ and composite oxides including A=Pb, Ba, and Sr, and B=Ti, Zr, Sn, Ni, Zn, Mg, and Nb as main components correspond to the materials. Specific examples of the composite oxides include $(Pb_{1-x}, Ba)(Zr, Ti)O_3$ and $(Pb_{1-x}, Sr)(Zr, Ti)O_3$, in which a part of Pb at A site is replaced with Ba or Sr. The substitution is enabled in a bivalent element and an effect thereof is to compensate characteristic deterioration by the evaporation of the lead during the heat treatment.

As a producing method, the composite oxides can be produced by a spin coater using a sputtering method or a sol-gel method. In such a case, because patterning is necessary, a desired pattern is obtained by photolithoetching. When the PZT is manufactured by the sol-gel method, lead acetate, zirconium alkoxide, and titanium alkoxide compounds are used as starting materials and are dissolved in methoxyethanol functioning as a common solvent and a uniform solution is obtained. Thereby, a PZT precursor solution can be produced. Since a metal alkoxide compound is easily hydrolyzed by atmospheric water, a stabilizer, such as acetylacetone, acetic acid, or diethanolamine may be appropriately added to the PZT precursor solution.

When the PZT film is formed on an entire surface of the base substrate, the PZT film is obtained by forming a coating by a solution coating method, such as a spin coating method, and performing each heat treatment of solvent drying, thermal decomposition, and crystallization on the coating. Transformation from the coating to a crystalline film causes volume contraction. Therefore, the concentration of the precursor solution is adjusted to obtain a film thickness of 100 nm or less by one step in order to obtain a crack-free film.

The film thickness of the electromechanical transducer film 12 is preferably in a range of from 1 μm to 3 μm, and more preferably in a range of from 1.5 μm to 2.5 μm. If the film thickness is less than the range, the pressure liquid chamber 31 may not be easily processed. If the film thickness is greater than the range, the substrate may be less deformed and displaced, thus hampering stable discharge of discharge liquid.

By the way, as illustrated hi FIG. 1, the electromechanical transducer element 10 is connected to an output side of a controller C via a head driver 50. A temperature detection sensor S1 to detect a temperature of the electromechanical transducer film 12 is connected to an input side of the controller C. In the present embodiment, the temperature detection sensor S1 is a detector to detect a drive state of the electromechanical transducer element 10. As the detection unit, a liquid droplet speed may be detected.

The controller C stores a data table C1 to adjust a characteristic fluctuation suppression voltage. The data table C1 is obtained by associating a detection result by the temperature detection sensor S1 with the characteristic fluctuation suppression voltage. That is, the data table C1 is obtained by associating a temperature of the electromechanical transducer film 12 with the characteristic fluctuation suppression voltage, thus allowing the characteristic fluctuation suppression voltage to change optimally according to a drive state.

The controller C described in the present embodiment has the following functions due to execution of a program. That is, the controller C has a function to apply a characteristic fluctuation suppression voltage to suppress characteristic fluctuation of the electromechanical transducer element 10 in a section between a drive waveform applied to the electromechanical transducer element 10 and a subsequent drive waveform. The function is referred to as a "characteristic fluctuation suppressor Ca". In the present embodiment, the characteristic fluctuation suppression voltage is larger than a negative coercive electric field of the electromechanical transducer film 12, is smaller than a positive coercive electric field of the electromechanical transducer film 12, and has such a waveform that a discharge liquid in the pressure liquid chamber 31 is not discharged. That is, in a characteristic fluctuation suppression method of the liquid discharge head A1, a characteristic fluctuation suppression voltage which is smaller than the coercive electric field of the electromechanical transducer film 12 and which has such a waveform that a discharge liquid in the pressure liquid chamber 31 is not discharged is applied in a section between a drive waveform applied to the electromechanical transducer element 10 and a subsequent drive waveform.

Figure 4A:
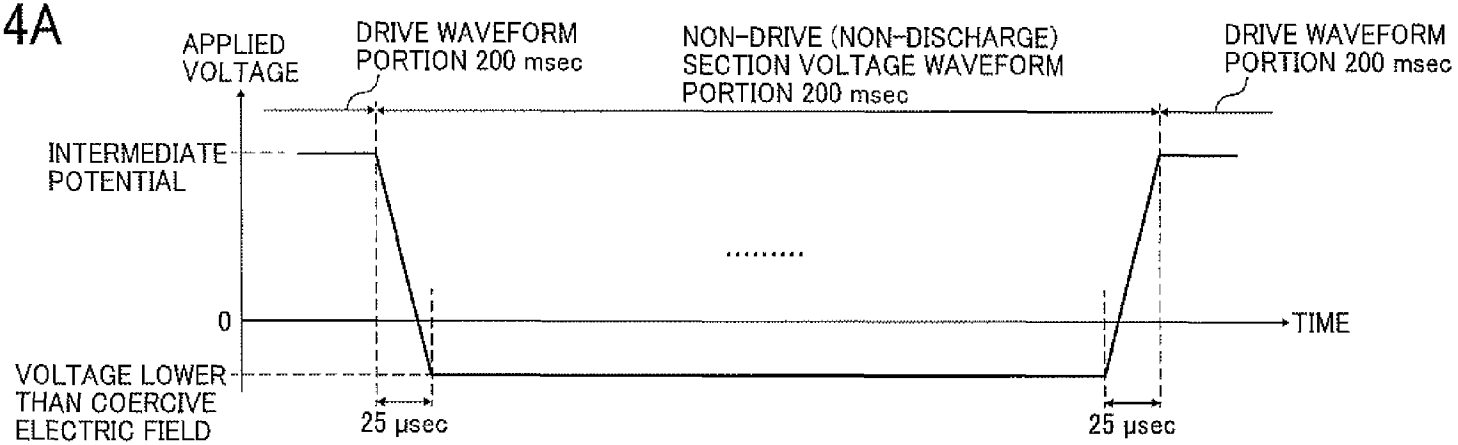
FIGS. 4A to 4C are each a schematic diagram of a waveform of a characteristic fluctuation suppression voltage applied in a section between a drive waveform of the electromechanical transducer element and a subsequent drive waveform.
Figure 4B:
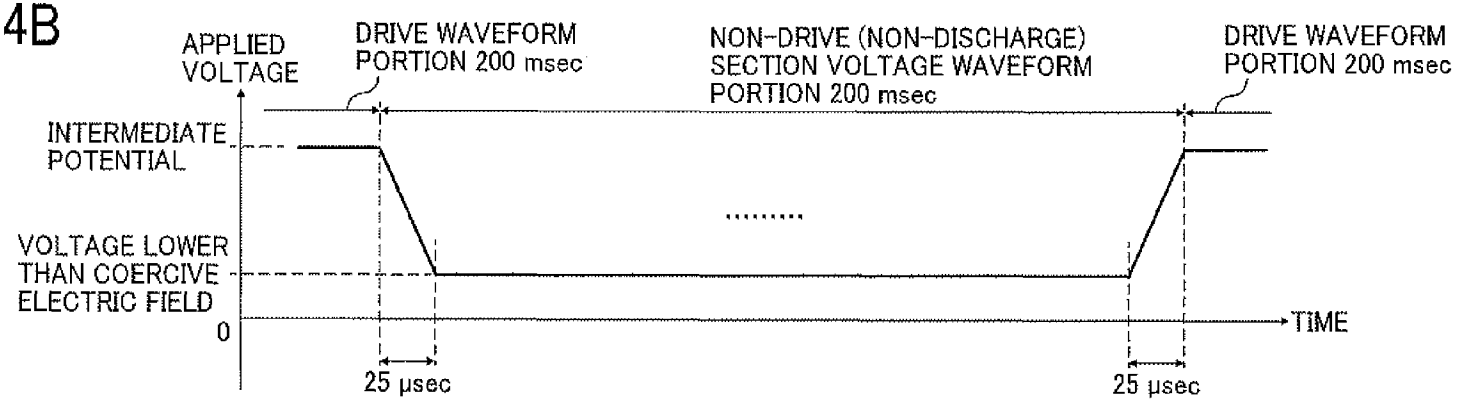
Figure 4C:
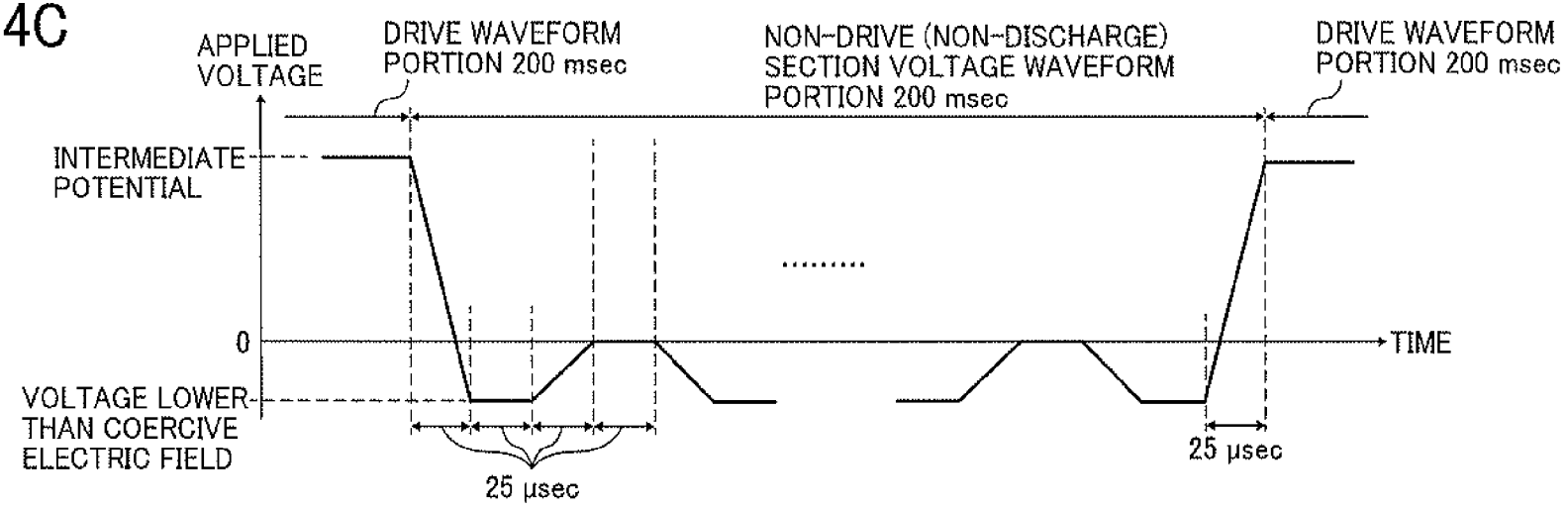

FIGS. 4A to 4C are each a schematic diagram of a waveform of a characteristic fluctuation suppression voltage applied in a section between a drive waveform of an electromechanical transducer element and a subsequent drive waveform. FIG. 4A illustrates a case where a voltage lower than a coercive electric field is 0 V or less. FIGS. 4B and 4C each illustrate a case where the voltage lower than a coercive electric field is 0 V or more. In FIG. 4C, the characteristic fluctuation suppression voltage is a pulse waveform. That is, the characteristic fluctuation suppression voltage has such a waveform that a discharge liquid in the pressure liquid chamber 31 is not discharged, is larger than a negative coercive electric field of the electromechanical transducer film 12, and is smaller than a positive coercive electric field of the electromechanical transducer film 12. In addition, the characteristic fluctuation suppression voltage is a direct-current (DC) voltage in which each of rise time and fall time of a waveform of the characteristic fluctuation suppression voltage is longer than a meniscus resonance period. In such a case, it is not necessary to introduce a particular waveform, and power consumption can he reduced due to no change in voltage. In addition, by making each of rise time and fall time longer than the meniscus resonance period, an excessive pressure is not generated in the pressure liquid chamber 31, and discharge is not caused unintentionally (the same thinking method for each of rise time and fall time is applied even to a case where the waveform does not have a pulse shape). That is, a discharge liquid is not discharged. In the present embodiment, a characteristic fluctuation suppression voltage value is determined by referring to the data table C1. However, for example, a characteristic fluctuation suppression voltage value may be determined sequentially by calculation without providing the data table C1. Furthermore, bias drive may be performed by applying a bias voltage to the lower electrode 13 or the upper electrode 11. In such a case, when a negative voltage is applied, the negative voltage can be applied to the electromechanical transducer element 10 without using a bipolar power supply, a negative voltage-corresponding DrIC, or the like particularly.

Figure 5:
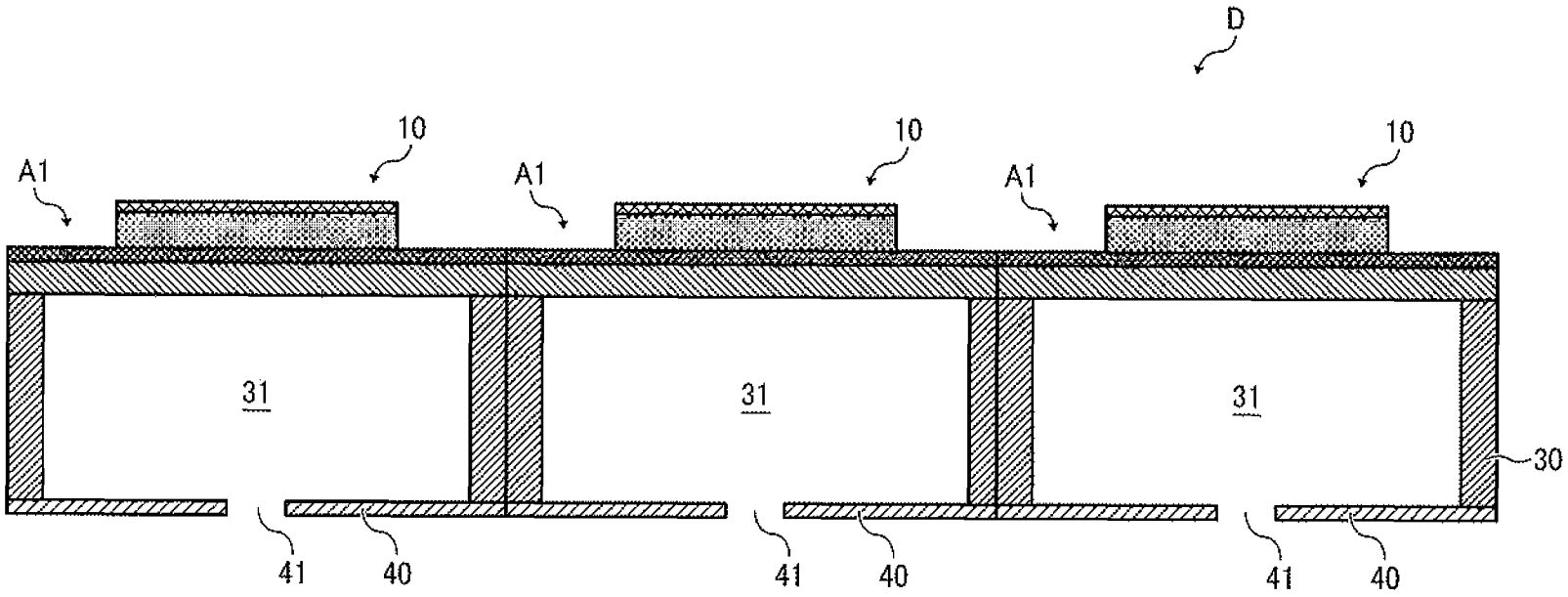
FIG. 5 is an enlarged cross sectional view illustrating a liquid discharge device having a plurality of the liquid discharge heads arranged in parallel.

FIG. 5 is an enlarged cross sectional view illustrating a liquid discharge device having a plurality of the liquid discharge heads arranged in parallel. The same codes as the codes of the components described in. FIG. 1 or the like are given to components equivalent to the components described in FIG. 1 or the like, and descriptions of the components equivalent to the components described in FIG. 1 or the like are omitted. A liquid discharge device D having the plurality of liquid discharge heads arranged in parallel can be used.

Figure 6A:
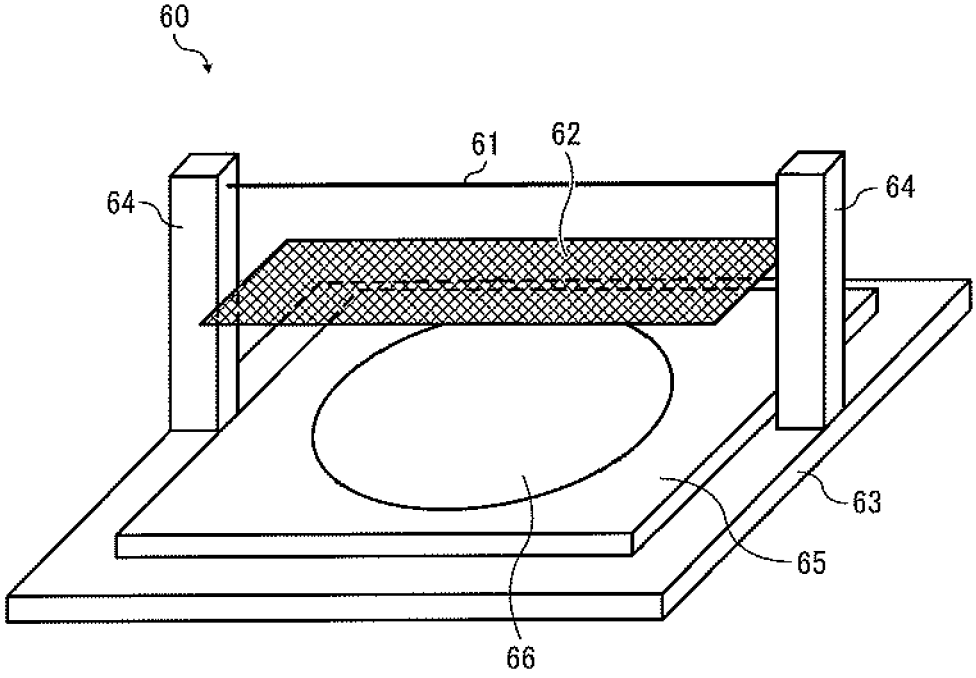
FIG. 6A is a perspective view illustrating a schematic configuration of a polarization processing apparatus.
Figure 6B:
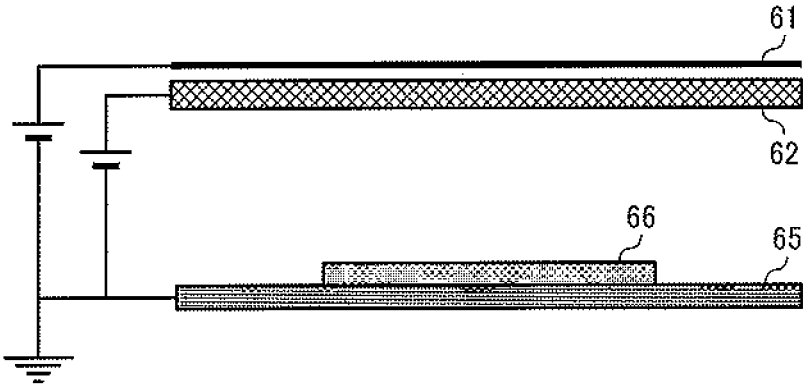
FIG. 6B is an explanatory diagram illustrating a circuit configuration.

The electromechanical transducer element 10 produced as described above was processed using a polarization processing apparatus illustrated in FIGS. 6A and 6B. FIG. 6A is a perspective view illustrating a schematic configuration of a polarization processing apparatus, and FIG. 6B is an explanatory diagram illustrating a circuit configuration.

A polarization processing apparatus 60 includes a corona electrode 61 and a grid electrode 62. The corona electrode 61 and the grid electrode 62 are disposed between supports 64 and 64 disposed on side edges facing to each other in a sample stage 63 having a square shape in planar view with a required gap. An earth plate 65 is disposed on the sample stage 63 while being apart from the corona electrode 61 and the grid electrode 62. When the earth plate 65 is not disposed, polarization processing may not be performed. The sample stage 63 has a temperature adjusting function, and polarization processing can be performed while the temperature is raised to 350° C.

The grid electrode 62 is formed into a mesh shape, and is designed such that an ion, a charge, or the like generated by corona discharge efficiently falls on the sample stage 63 when a high voltage is applied to the corona electrode 61. By adjusting a voltage applied to each of the corona electrode 61 and the grid electrode 62 and a distance between a sample 66 and each of the electrodes 61 and 62, corona discharge can be performed strongly or weakly.

Figure 7:
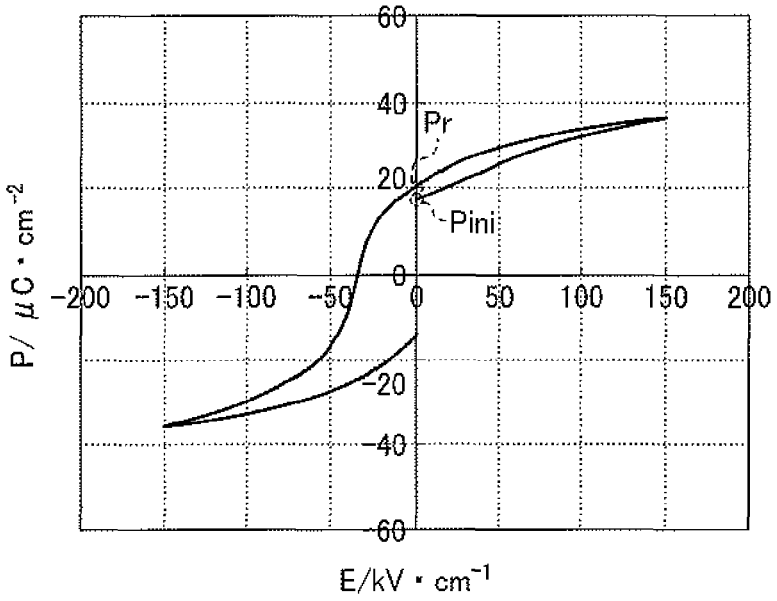
FIG. 7 is a graph illustrating a P-E hysteresis loop.

FIG. 7 is a graph chart of P-E hysteresis loop. The state of polarization processing is determined with reference to a P-E hysteresis loop illustrated in FIG. 7. As illustrated in FIG. 7, a hysteresis loop was measured with a field strength of ±150 kV/cm applied. When polarization at 0 kV/cm at the beginning is referred to as Pini and polarization at 0 kV/cm obtained by applying a voltage at ±150 kV/cm and then returning the field strength to 0 kV/cm is referred to as Pr, a value of Pr-Pini is defined as a polarization ratio. A polarization state is determined from the polarization ratio.

Here, the polarization ratio Pr-Pini is preferably 10 $\mu C/cm^2$ or less, and more preferably 5 $\mu C/cm^2$ or less. When the polarization ratio Pr-Pini is less than the value, a sufficient characteristic for displacement deterioration as a PZT piezoelectric actuator after continuous drive may not be obtained. A desirable polarization ratio Pr-Pini can be obtained by adjusting voltages of the corona electrode 61 and the grid electrode 62, a distance between the sample stage 63 and each of the corona electrode 61 and the grid electrode 62, or the like in the polarization processing apparatus 60 illustrated in FIG. 6.

Hereinafter, Examples of the present disclosure will be described.

EXAMPLE 1

The diaphragm 20 was produced by forming $SiO_2$ (film thickness 600 nm), Si (film thickness 200 nm), $SiO_2$ (film thickness 100 nm), SiN (film thickness 150 nm), $SiO_2$ (film thickness 1300 nm), SiN (film thickness 150 nm), $SiO_2$ (film thickness 100 nm), Si (film thickness 200 nm), and $SiO_2$ (film thickness 600 nm) in the recited order on a 6-inch silicon wafer. Thereafter, as an adhesive film as the first electrode 10*c* and the second electrode 10*e*, a titanium film (film thickness 20 nm) was formed at a film formation temperature of 350° C. using a sputtering apparatus, and then was thermally oxidized at 750° C. using rapid thermal annealing (RTA). Subsequently, as a metal film, a platinum film (film thickness 160 nm) was formed at a film formation temperature of 400° C. using a sputtering apparatus. Subsequently, a solution adjusted so as to have a ratio of Pb:Ti=1:1 as a $PbTiO_3$ layer serving as a base layer and a solution adjusted so as to have a ratio of Pb:Zr:Ti=115:49:51 as the electromechanical transducer film 12 were prepared, and a film was formed by a spin coating method.

For synthesis of a specific precursor coating liquid, lead acetate trihydrate, titanium isopropoxide, and zirconium isopropoxide were used as starting materials. Crystal water of lead acetate was dissolved in methoxyethanol and was then dehydrated. The amount of lead is excessively large for a stoichiometric composition, to prevent reduction in crystallinity by so-called lead missing during heat treatment. The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor solution was synthesized. The concentration of PZT was prepared to he 0.5 mol/l. A PT solution was produced in a similar manner to PZT. First, a PT layer film was formed by spin-coating using these solutions. After film formation, the PT layer film was dried at 120° C. Thereafter, a film was formed by spin coating using the PZT solution, was dried at 120° C., and then was subjected to pyrolysis at 400° C. The third layer was subjected to pyrolysis, and then was subjected to a crystallization heat treatment (temperature 730° C.) by RTA. At this time, the film thickness of PZT was 240 nm. The step was performed eight times (24 layers) in total to obtain a PZT film thickness of about 2 μm.

Subsequently, a $SrRuO_3$ film (film thickness 40 nm) was formed by sputtering as an oxide film of each of the third and fourth electrodes, and a Pt film (film thickness 125 nm) was formed by sputtering as a metal film. Then, a film was formed by the spin coating method using a photoresist (TSMR8800) manufactured by TOKYO OHKA KOGYO., LTD, a resist pattern was formed by a normal photolithographic method, and a pattern illustrated in FIGS. 4A, 4B, and 4C was manufactured using an ICP etching device (manufactured by SAMCO INC.). Subsequently, an $Al_2O_3$ film of 50 nm was formed using an ALD method as the first insulating protective film 10*f*. At this time, as raw materials, TMA (Sigma-Aldrich Corporation) for Al and $O_3$ generated by an ozone generator for 0 were stacked alternately, and film formation was thereby performed. Thereafter, as illustrated in FIGS. 3A and 3B, the contact hole 10*j* was formed by etching. Thereafter, a film of Al was formed by sputtering as metal wiring. Patterning was formed by etching. A film of $Si_3N_4$ was formed by plasma CVD so as to have a film thickness of 500 nm as the second insulating protective film 10 g to produce the electromechanical transducer element 10. The electromechanical transducer element 10 was designed such that 300 electromechanical transducer elements 10 were arranged in a row in one chip.

A bonding step to bond a holding substrate was formed by a similar step. The bonding step was disposed at a position corresponding to a partition wall of the pressure liquid chamber 31. In the step of forming the first insulating protective film 10*f*, the same layers as the first insulating protective film 10*f*, the metal wiring, and the second insulating protective film 10*g* were formed at a position corresponding to the partition wall of the pressure liquid chamber 31. That is, the bonding step was formed by stacking the same layer as the first insulating protective film 10*f*, the same layer as the metal wiring, and the same layer as the second insulating protective film 10*g*. The bonding step was not disposed in an activation portion of the electromechanical transducer element 10, was not disposed outside the partition wall of the pressure liquid chamber 31, but was formed at a position having no influence on a deformation region of the diaphragm 20

Then, polarization processing was executed by corona charging. For the corona charging, a tungsten wire of φ50 μm was used, and a stainless steel grid electrode having an opening ratio of 60% was used as the grid electrode 62. Polarization processing was performed under the following conditions. That is, a processing temperature was 80° C., a corona voltage was 9 kV, a grid voltage was 1.5 kV, processing time was 30 s, a distance between the corona electrode 61 and the grid electrode 62 was 4 mm, and a distance between the grid electrode 62 and the stage 63 was 4 mm.

The common electrode PAD 10*k* and the individual electrode PAD 10*l* to he connected to the third electrode 10*h* and the fourth electrode 10*i* were formed. A distance between the individual electrodes PAD 10*l* was 80 μm. Thereafter, as illustrated in FIG. 1, Si on a back surface was etched to produce the electromechanical transducer element 10 also having the pressure liquid chamber 31 (width 60 μm) formed. At this time, in order to hold the pressure liquid chamber 31, the holding substrate was bonded, and then Si etching was performed from a back surface of the wafer. An opening of the holding substrate covering the electromechanical transducer element 10 had a width of 75 μm. Thereafter, the liquid discharge head A1 constituted using the produced electromechanical transducer element 10 was produced.

Figure 8:
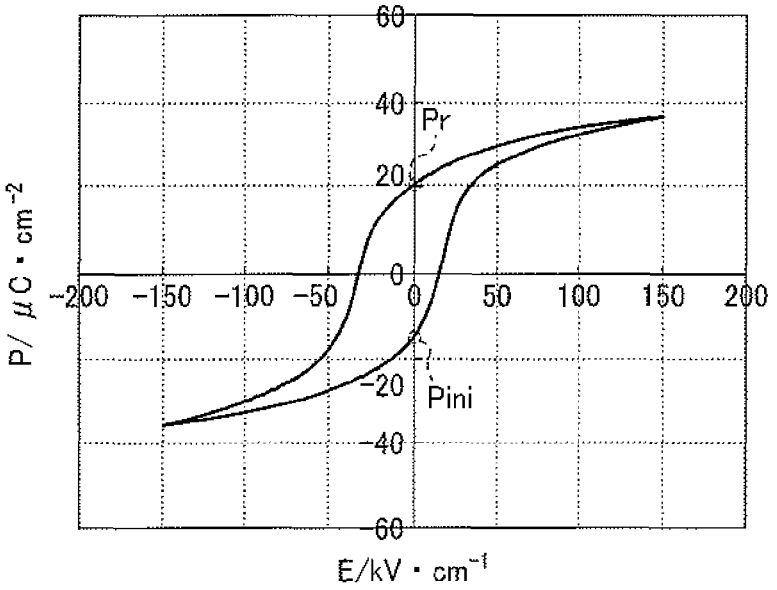
FIG. 8 is a graph illustrating a P-E hysteresis loop of the electromechanical transducer element in the present Example.

FIG. 8 is a graph illustrating a P-E hysteresis loop of the electromechanical. transducer element 10 in the present Example. Evaluation for fluctuation of a discharge-speed was performed using the produced liquid discharge head A1. Hereinafter, as a voltage expression, a potential state when the electromechanical transducer element 10 was viewed as an object will be defined. A waveform is formed by applying a voltage waveform to an individual electrode and applying a bias voltage to a common electrode. There is no difference even when a voltage waveform applied to the electromechanical transducer element 10 is controlled only by the individual electrode.

A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a DC voltage waveform at a field strength of −5 kV/cm not higher than a coercive electric field having an opposite polarity to an intermediate potential (here, positive polarity) of the drive waveform for 200 msec as one sequence was applied. Each of fall time and rise time (or each of through-down time and through-up time) from the drive waveform to the DC voltage waveform was sufficiently longer than the meniscus resonance period. In the configuration of the liquid discharge head A1, the meniscus resonance period Tc was 3.7 μsec. Therefore, the fall time was set to 25 μsec, and the rise time was set to 25 μsec.

EXAMPLE 2

Evaluation for fluctuation of a discharge-speed was performed using the produced liquid discharge head A1. A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a DC voltage waveform at a field strength of −2.5 kV/cm not higher than a coercive electric field having an opposite polarity to an intermediate potential (here, positive polarity) of the drive waveform for 200 msec as one sequence was applied. Each of fall time and rise time (or each of through-down time and through-up time) from the drive waveform to the DC voltage waveform was sufficiently longer than the meniscus resonance period. In the configuration of the liquid discharge head A1, the meniscus resonance period Tc was 3.7 μsec. Therefore, the fall time was set to 25 μsec, and the rise time was set to 25 μsec.

EXAMPLE 3

Evaluation for fluctuation of a discharge-speed was performed using the produced liquid discharge head A1. A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a DC voltage waveform at a field strength of 5.0 kV/cm not higher than a coercive electric field having the same polarity as an intermediate potential (here, positive polarity) of the drive waveform for 200 msec as one sequence was applied. Each of fall time and rise time (or each of through-down time and through-up time) from the drive waveform to the DC voltage waveform was sufficiently longer than the meniscus resonance period. In the configuration of the liquid discharge head A1, the meniscus resonance period Tc was 3.7 μsec. Therefore, the fall time was set to 25 μsec, and the rise time was set to 25 μsec.

EXAMPLE 4

Evaluation for fluctuation of a discharge-speed was performed using the produced liquid discharge head A1. A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a DC voltage waveform at a field strength of 2.5 kV/cm not higher than a coercive electric field having the same polarity as an intermediate potential (here, positive polarity) of the drive waveform for 200 msec as one sequence was applied. Each of fall time and rise time (or each of through-down time and through-up time) from the drive waveform to the DC voltage waveform was sufficiently longer than the meniscus resonance period. In the configuration of the liquid discharge head A1, the meniscus resonance period Tc was 3.7 μsec. Therefore, the fall time was set to 25 μsec, and the rise time was set to 25 μsec.

COMPARATIVE EXAMPLE 1

Evaluation for fluctuation of a discharge-speed was performed using the produced liquid discharge head A1. A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a pulse waveform at a field strength of −2.5 kV/cm not higher than a coercive electric field having an opposite polarity to an intermediate potential (here, positive polarity) of the drive waveform for 200 msec as one sequence was applied. Here, in the pulse waveform, each of rise time, maintaining time, and fall time was longer than the meniscus resonance period. In the configuration of the liquid discharge head A1, the meniscus resonance period Tc was 3.7 μsec. Therefore, the rise time was set to 25 μsec, the pulse width was set to 25 μsec, and the fall time was set to 25 μsec.

COMPARATIVE EXAMPLE 2

Evaluation for fluctuation of a discharge-speed was performed using the produced liquid discharge head A1. A drive waveform formed with a pulse waveform in which a positive voltage side had a voltage width higher than a coercive electric field and a negative voltage side had a voltage width not higher than the coercive electric field was applied for 200 msec. Thereafter, a waveform including application of a DC voltage waveform at a field strength of −40 kV/cm higher than a coercive electric field having an opposite polarity to an intermediate potential (here, positive polarity) of the drive waveform for 200 msec as one sequence was applied. Each of fall time and rise time (or each of through-down time and through-up time) from the drive waveform to the DC voltage waveform was sufficiently longer than the meniscus resonance period. In the configuration of the liquid discharge head A1, the meniscus resonance period Tc was 3.7 μsec. Therefore, the fall time was set to 25 μsec, and the rise time was set to 25 μsec.

A discharge speed after driving was performed only with a drive waveform at the drive count of $1.0\times10^9$ was used as a standard. Thereafter, by applying waveforms in Examples and Comparative Examples $5.0\times10^9$ times, a discharge-speed change rate was evaluated. Here, the pulse number of a recovery waveform was not counted, but only the pulse number of the drive waveform was counted. Driving was performed only with the drive waveform at the beginning only in order to make an effect clear.

Figure 9A:
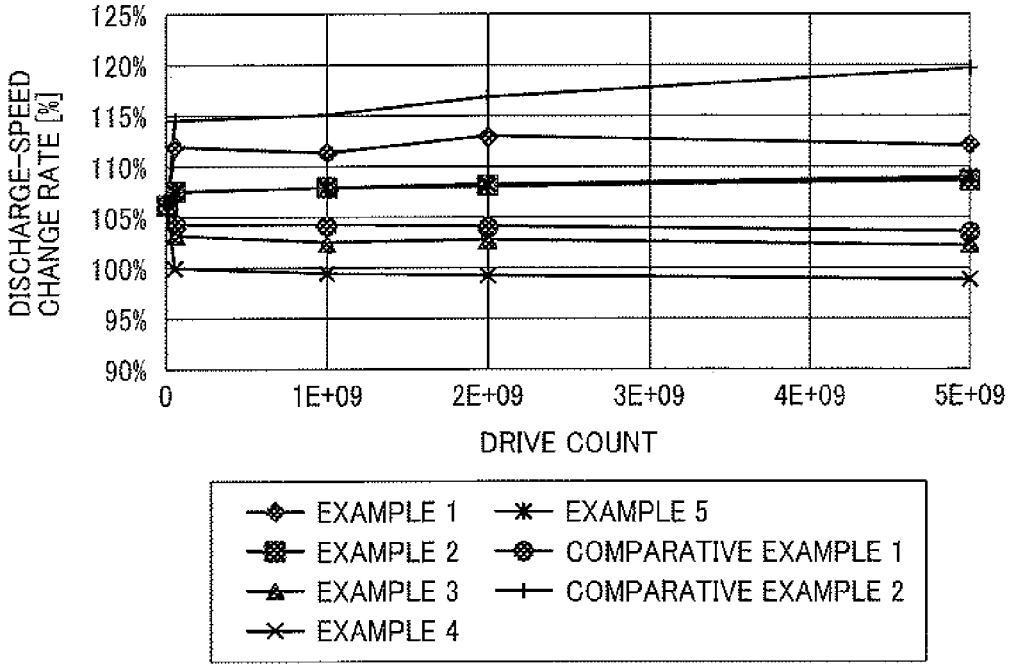
FIGS. 9A and 9B are each a graph illustrating an evaluation result of a discharge-speed after driving is performed $5.0\times10^9$ times.
Figure 9B:
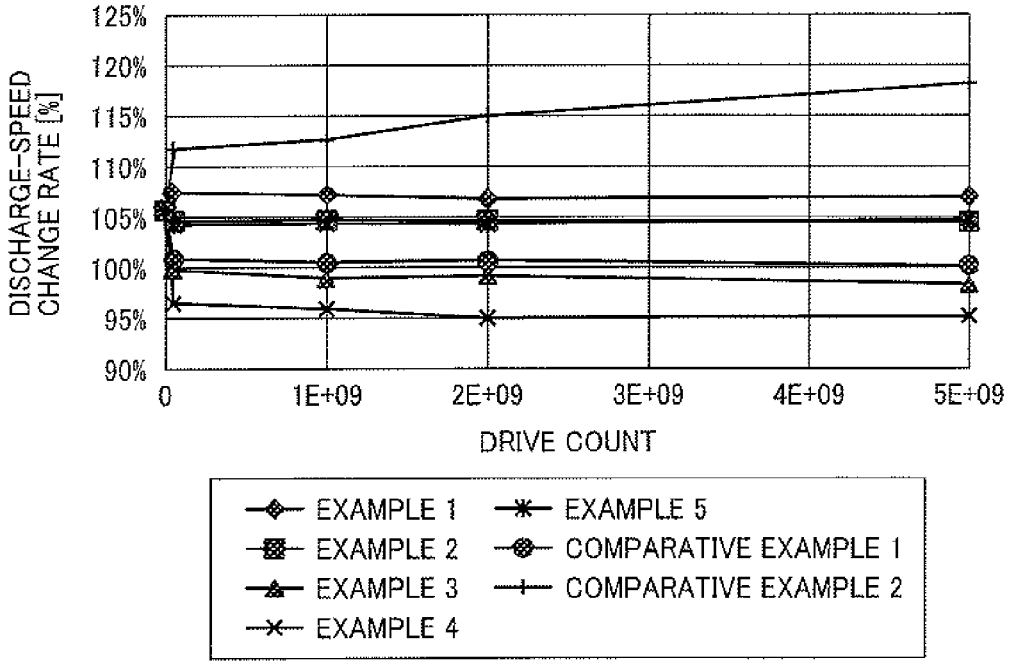

FIGS. 9A and 9B are each a graph illustrating an evaluation result of a discharge-speed after driving is performed $5.0\times10^9$ times. FIG. 9A illustrates a graph at a high temperature. FIG. 9B illustrates a graph at a low temperature. Table 1 collectively indicates a discharge-speed change rate after driving is repeatedly performed $5.0\times10^9$ times. In addition, in Table 1, the change rate is indicated by assuming an initial discharge-speed to be 100%, and start for applying waveforms in Examples and Comparative Examples is indicated by "0".

TABLE 1

| | High Temperature | Low Temperature |
|---|---|---|
| Example 1 | 112% | 97% |
| Example 2 | 109% | 95% |
| Example 3 | 102% | 88% |
| Example 4 | 99% | 85% |
| Example 5 | 109% | 95% |
| Comparative Example 1 | 104% | 90% |
| Comparative Example 2 | 120% | 108% |

Table 1 indicates results performed at two levels of 10° C. (low temperature) and 40° C. (high temperature) as temperature environments in Examples 1 to 5 and Comparative Examples 1 and 2. When driving was performed only with the drive waveform, there was a difference in the discharge-speed between these two levels. It is considered that this is because a reaction force from a discharge target object was changed (It is considered that this is caused by a relationship between viscosity of a discharge fluid and temperature or the like).

Thereafter, driving was performed repeatedly in Examples. As a result, it is found that a voltage during non-drive basically determines a discharge-speed change rate in a later step. It is considered that this is caused by a balance state between an inner stress of the electromechanical transducer element 10 and a reaction force from a discharge liquid. That is, it is considered that the discharge-speed is increased in a case where discharge is easily performed due to a stress balance (the electromechanical transducer element 10 is easily displaced). On the other hand, it is considered that the discharge-speed is decreased in the opposite case in which discharge is not easily performed due to a stress balance. During application of a drive waveform, a voltage in a constant direction is applied, and a load is increased. However, it is considered that the balance is changed by applying a small voltage during non-discharge.

In Examples 2 and 5, a DC waveform and a pulse waveform were compared with each other, but there was no large difference the DC waveform and the pulse waveform. Therefore, it is only required to make a decision considering consumption power at each of rise time and fall time of a waveform or the like. Comparative Example 2 indicates a case where a voltage equal to or higher than a coercive electric field is applied. In Examples, a change is hardly observed after the initial change in the discharge-speed (matching of a stress balance). However, in Comparative Example 2, a continuous change is observed. It is considered that this is because characteristics of the electromechanical transducer element 10 are changed continuously by applying a voltage equal to or higher than a coercive electric field. Therefore, a voltage less than the coercive electric field is selected.

The above-described results indicate that it is possible to correspond to fluctuation of the discharge-speed during repeated drive by changing a voltage during non-drive. The results at the two standards of temperatures have been indicated. By changing control of a voltage during non-drive with respect to fluctuation according to a temperature, continuous discharge stability is enhanced. As a detection unit, the temperature detection sensor S1 is only required. If a direct detection unit for detecting a viscosity of a discharge liquid or detecting a discharge-speed is further present, control can be performed with higher accuracy. By storing a data table to cause a detected result to be fed back to voltage control in a memory, a voltage during non-discharge can be performed.

A voltage waveform is applied to an individual electrode, a bias voltage is applied to a common electrode, and a negative voltage is applied to the electromechanical transducer element 10. This is because the negative voltage can be applied to the electromechanical transducer element 10 without preparing a bipolar power supply, a negative voltage-corresponding driver IC to control the electromechanical transducer element 10, or the like particularly.

According to the above-described aspects of the present disclosure, the electromechanical transducer element 10 can be formed by a simple production method (so as to have performance equal to bulk ceramics). In addition, by performing etching removal from a back surface to form a pressure liquid chamber in a later step and bonding a nozzle plate having a nozzle orifice, a liquid discharge head can be produced. Note that, in the above-described embodiment, descriptions of a liquid supply unit, a channel, and a fluid resistance are omitted.

Figure 10:
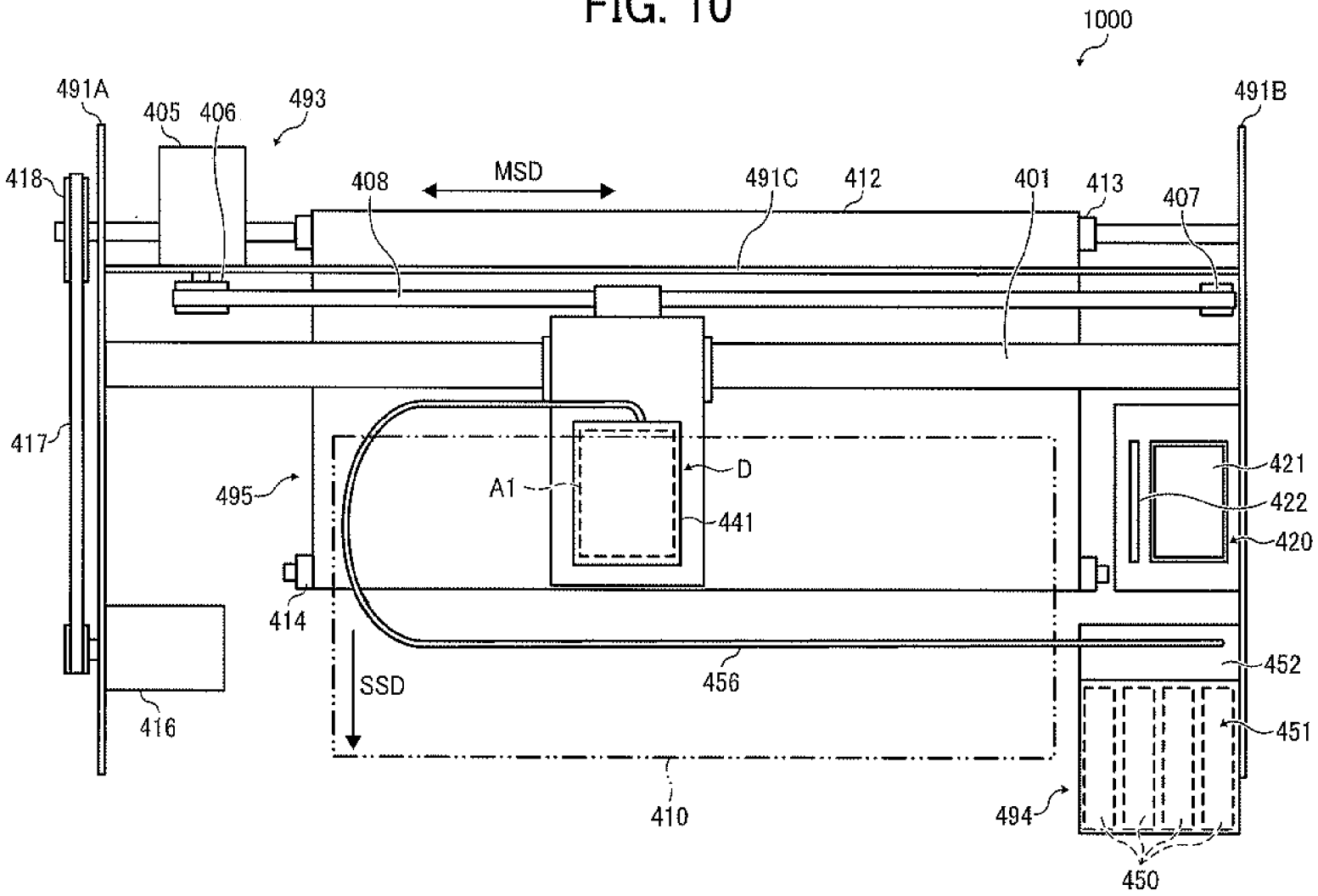
FIG. 10 is a plan view for explaining main parts of a liquid discharge apparatus according to an embodiment.
Figure 11:
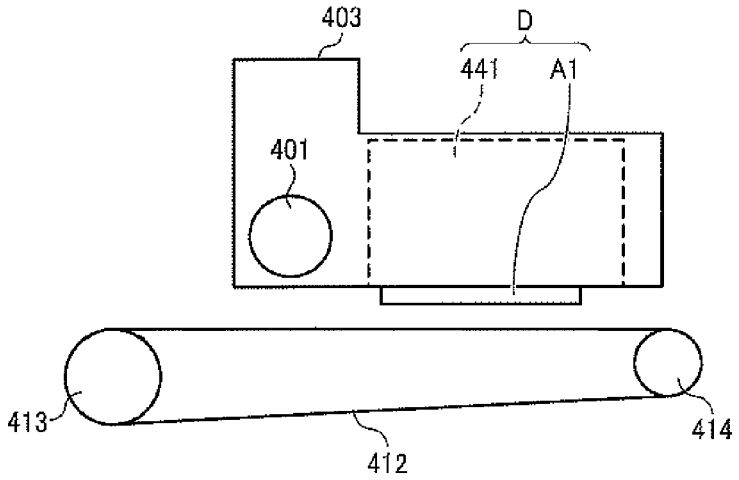
FIG. 11 is a side view for explaining main parts of the liquid discharge apparatus.

Next, a liquid discharge apparatus according to an embodiment of the present disclosure is described with reference to FIGS. 10 and 11. FIG. 10 is a plan view of a portion of the liquid discharge apparatus according to an embodiment of the present disclosure. FIG. 11 is a side view of a portion of the liquid discharge apparatus of FIG. 10.

A liquid discharge apparatus 1000 according to the present embodiment is a serial-type apparatus in which a main scan moving unit 493 reciprocally moves a carriage 403 in a main scanning direction indicated by arrow MSD in FIG. 10. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device D in which the liquid discharge head A1 and a head tank 441 are integrated as a single unit. The liquid discharge head A1 of the liquid discharge device D discharges ink droplets of respective colors of yellow (Y), cyan (C), magenta (M), and black (K). The liquid discharge head A1 includes nozzle rows, each including a plurality of nozzles arrayed in row in a sub-scanning direction, which is indicated by arrow SSD in FIG. 10, perpendicular to the main scanning direction MSD. The liquid discharge head A1 is mounted to the carriage 403 so that ink droplets are discharged downward.

The liquid stored outside the liquid discharge head A1 is supplied to the liquid discharge head A1 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head A1. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head A1 in good condition is disposed on a lateral side of the conveyance belt 412.

The maintenance unit 420 includes, for example, a cap 421 to cap a nozzle face (i.e., a face on which the nozzles are formed) of the liquid discharge head A1 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head A1 is driven in response to image signals while the carriage 403 moves in the main scanning direction MSD, to discharge liquid to the sheet 410 stopped, thus forming an image on the sheet 410. As described above, the liquid discharge apparatus 1000 includes the liquid discharge head A1 according to an embodiment of the present disclosure, thus allowing stable formation of high quality images.

Figure 12:
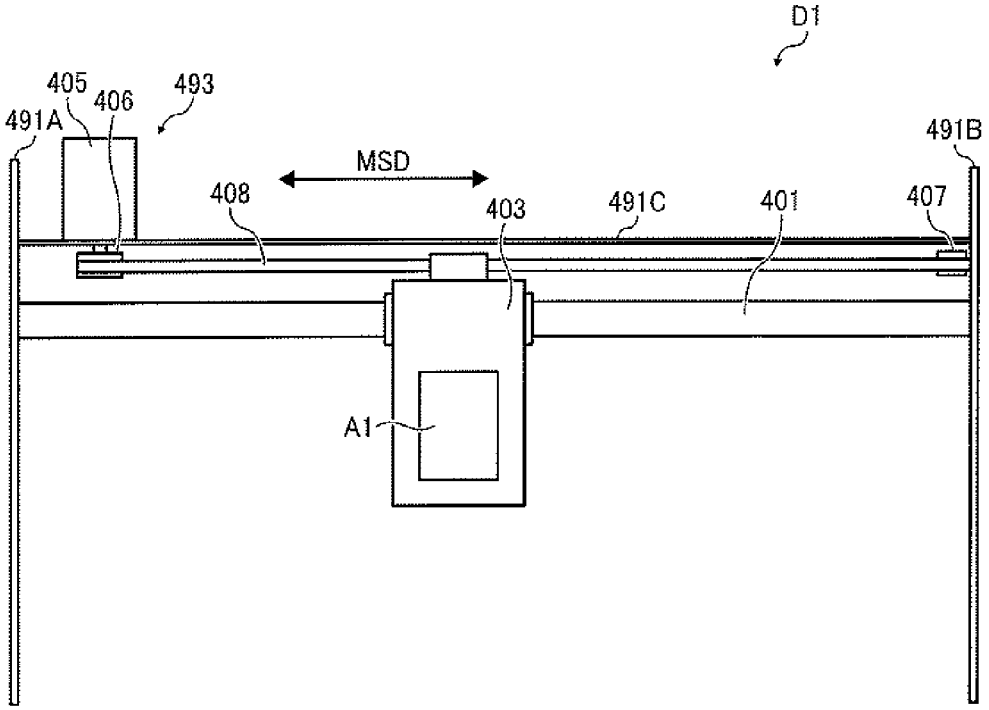
FIG. 12 is a plan view for explaining main parts of the liquid discharge device.

Next, another example of the liquid discharge device according to an embodiment of the present disclosure is described with reference to FIG. 12. FIG. 12 is a plan view of a portion of another example of the liquid discharge device (liquid discharge device D1. The liquid discharge device D1 includes the housing, the main scan moving unit 493, the carriage 403, and the liquid discharge head A1 among components of the liquid discharge apparatus 1000. The left side plate 491A, the right side plate 491B, and the rear side plate 491C form the housing.

Figure 13:
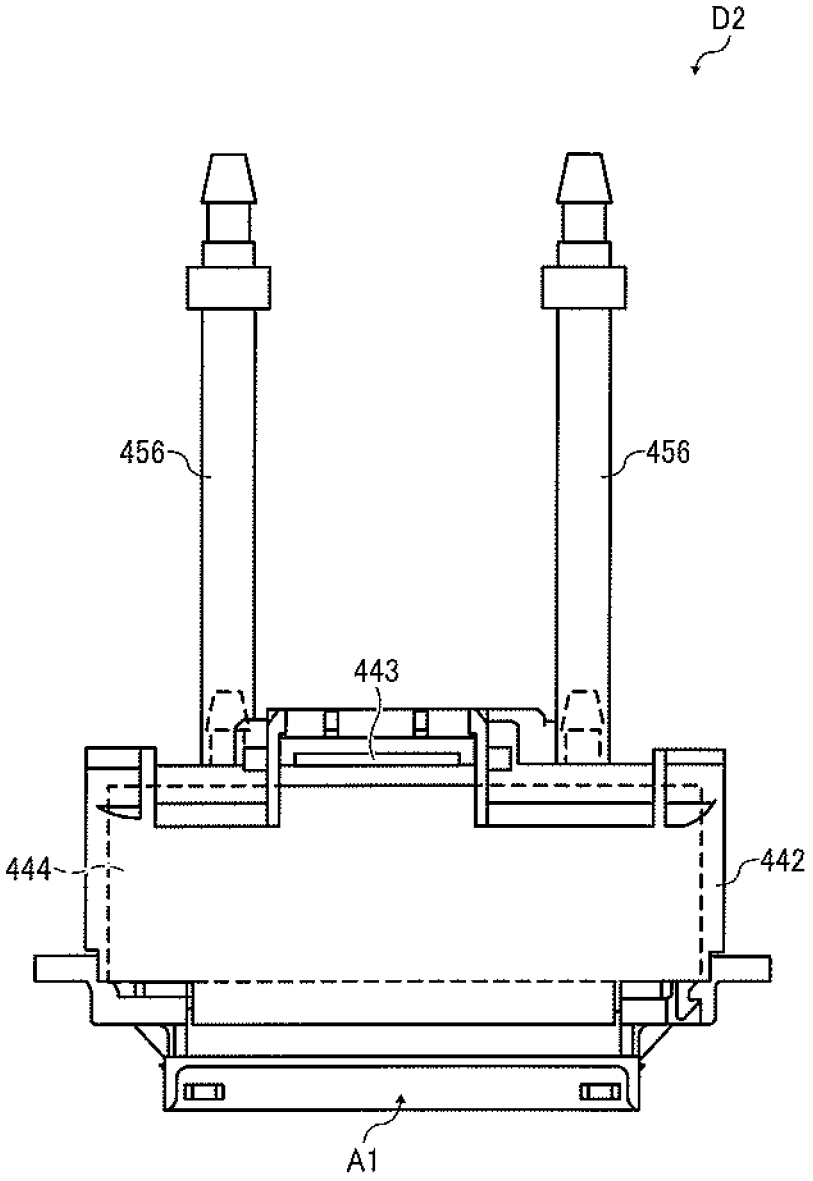
FIG. 13 is a front view for explaining main parts of the liquid discharge device.

Note that, in the liquid discharge device D1, at least one of the maintenance unit 420 and the supply unit 494 may be mounted on, for example, the right side plate 491B, Next, still another example of the liquid discharge device according to an embodiment of the present disclosure is described with reference to FIG. 13. FIG. 13 is a plan view of a portion of still another example of the liquid discharge device (liquid discharge device D2). The liquid discharge device D2 includes the liquid discharge head A1 to which a channel part 444 is mounted, and the tube 456 connected to the channel part 444.

Further, the channel part 444 is disposed inside a cover 442. Instead of the channel part 444, the liquid discharge device D2 may include the head tank 441. A connector 443 to electrically connect the liquid discharge head A1 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged. Examples of the liquid discharge apparatus include an image forming apparatus to form an image on a sheet by discharging ink, and a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

The material on which liquid can be adhered may be any material on which liquid can be adhered even temporarily, such as paper, thread, fiber, fabric, leather, metal, plastic, glass, wood, or ceramic. Examples of the liquid are, e.g., ink, treatment liquid, DNA sample, resist, pattern material, binder, mold liquid, or solution and dispersion liquid including amino acid, protein, or calcium.

The liquid discharge apparatus may be an apparatus to relatively move a liquid discharge head and a material on which liquid can he adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may he detachably attached to the functional part(s) or unit(s) s each other.

The liquid discharge device may be, for example, a liquid discharge device in which the liquid discharge head and the head tank are integrated as a single unit, such as the liquid discharge device D illustrated in FIG. 11. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage. In still another example, the liquid discharge device may be the liquid discharge head movably held by a guide that forms part of a main-scanning moving device, so that the liquid discharge head and the main-scanning moving device are integrated as a single unit. Like the liquid discharge device D1 illustrated in FIG. 12, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device D2 illustrated in FIG. 13, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used the above-described embodiments of the present disclosure may be used synonymously with each other.

Figure 14A:
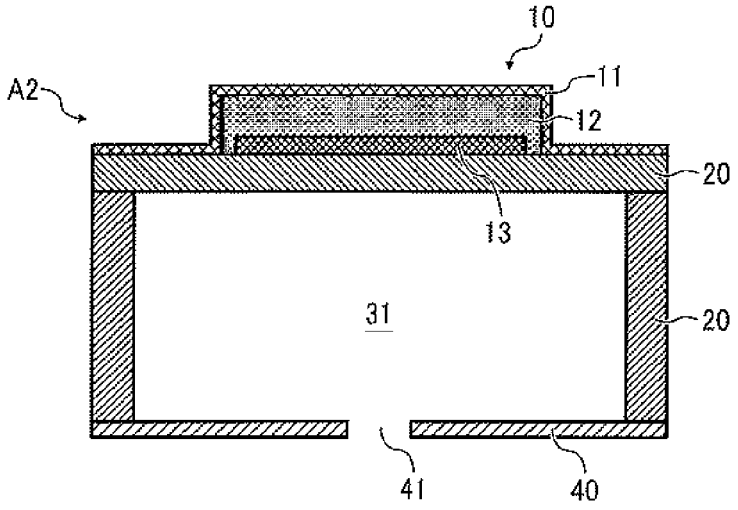
FIG. 14A is an enlarged cross sectional view illustrating a schematic configuration of a liquid discharge head according to another embodiment of the present disclosure.
Figure 14B:
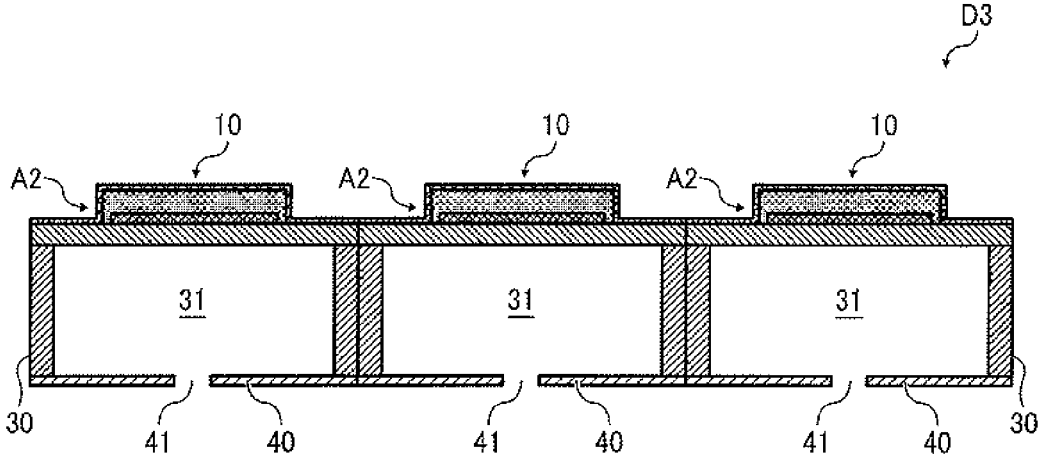
FIG. 14B is a cross sectional view illustrating a liquid discharge device having a plurality of the liquid discharge heads arranged in parallel.

A liquid discharge head according to an aspect of the present disclosure is not limited to the liquid discharge head A1 having the above-described configuration, but may have the following configuration. FIG. 14A is an enlarged cross sectional view illustrating a schematic configuration of a liquid discharge head according to another embodiment of the present disclosure. FIG. 14B is a cross sectional view illustrating a liquid discharge device having a plurality of the liquid discharge heads arranged in parallel.

A liquid discharge head A2 according to another embodiment illustrated in FIGS. 14A and 14B mainly includes an electromechanical transducer element 10, a diaphragm 20, a pressure chamber substrate 30, and a nozzle plate 40. The present embodiment is different in that an upper electrode 11 is a common electrode and a lower electrode 13 is an individual electrode. In a similar manner to the above-described liquid discharge head A1, a liquid discharge device D3 having a plurality of the liquid discharge heads A2 arranged in parallel can be used.

As described above, according to at least one embodiment of the present disclosure, a liquid discharge head, a the liquid discharge device, and a liquid discharge apparatus can obtain a stable ink discharge characteristic while suppressing characteristic fluctuations due to repeated driving of an electromechanical transducer element.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle plate having a nozzle orifice communicated with a pressure liquid chamber to discharge a discharge liquid stored in the pressure liquid chamber;

a diaphragm dividing a part of the pressure liquid chamber;

an electromechanical transducer element disposed on the diaphragm, the electromechanical transducer element including a lamination of a lower electrode, an electromechanical transducer film, and an upper electrode; and a characteristic fluctuation suppressor to apply a characteristic fluctuation suppression voltage to suppress characteristic fluctuation of the electromechanical transducer element in a section between a drive waveform applied to the electromechanical transducer element and a subsequent drive waveform, the characteristic fluctuation suppressor to set the characteristic fluctuation suppression voltage to be larger than a negative coercive electric field of the electromechanical transducer film and smaller than a positive coercive electric field of the electromechanical transducer film and have a waveform that does not discharge the discharge liquid in the pressure liquid chamber.

2. The liquid discharge head according to claim 1, wherein each of a rise time and a fall time of the waveform of the characteristic fluctuation suppression voltage is longer than a meniscus resonance period.

3. The liquid discharge head according to claim 1, wherein the characteristic fluctuation suppression voltage is a direct-current voltage.

4. The liquid discharge head according to claim 1, wherein the characteristic fluctuation suppressor applies a bias voltage to one of the lower electrode and the upper electrode.

5. The liquid discharge head according to claim 1, further comprising a data table to adjust a value of the characteristic fluctuation suppression voltage, wherein the characteristic fluctuation suppressor refers to the data table to determine the value of the characteristic fluctuation suppression voltage.

6. The liquid discharge head according to claim 5, further comprising a detector to detect a temperature of the electromechanical transducer film, wherein the data table contains data associating a detection result of the detector with the value of the characteristic fluctuation suppression voltage, and wherein the characteristic fluctuation suppressor refers to the data table according to the temperature of the electromechanical transducer film detected with the detector, to determine the value of the characteristic fluctuation suppression voltage.

7. A liquid discharge device comprising the liquid discharge head according to claim 1.

8. The liquid discharge device according to claim 7, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

9. A liquid discharge apparatus comprising the liquid discharge device according to claim 7.

10. A liquid discharge apparatus comprising the liquid discharge head according to claim 1.

* * * * *